United States Patent [19]

Röth

[11] 4,237,359

[45] Dec. 2, 1980

[54] METHOD AND APPARATUS FOR THE ELECTROINDUCTION HEATING OF METAL WORKPIECES

[75] Inventor: Günther Röth, Remscheid, Fed. Rep. of Germany

[73] Assignee: Thyssen Industrie AG, Fed. Rep. of Germany

[21] Appl. No.: 863,702

[22] Filed: Dec. 23, 1977

Related U.S. Application Data

[63] Continuation of Ser. No. 701,129, Jun. 30, 1976, abandoned.

[51] Int. Cl.[3] ..... H05B 6/02; H05B 6/26; C21D 1/74

[52] U.S. Cl. ..... 219/10.41; 219/10.49 R; 219/10.67; 13/26; 266/253; 266/129

[58] Field of Search ..... 219/10.49, 10.57, 10.79, 219/10.71, 10.69, 10.41, 10.43, 10.67, 7.5, 10.73; 266/129, 249, 250, 253, 262, 263, 261; 13/26, 27

[56] References Cited

U.S. PATENT DOCUMENTS

| | | | |
|---|---|---|---|
| 1,925,028 | 8/1933 | Brieger | 219/10.37 |
| 2,461,765 | 2/1949 | Olt | 219/10.57 |
| 2,506,425 | 5/1950 | Journeaux | 219/10.69 |
| 2,869,856 | 1/1959 | Greene | 266/253 |
| 3,291,954 | 12/1966 | Scheffler | 219/10.71 |
| 3,894,892 | 7/1975 | Conta | 219/10.41 |
| 3,926,415 | 12/1975 | Konas et al. | 219/10.73 |

*Primary Examiner*—B. A. Reynolds
*Assistant Examiner*—Philip H. Leung
*Attorney, Agent, or Firm*—McGlew and Tuttle

[57] ABSTRACT

A method of heating metal workpieces so as to minimize scale formation and decarburization using an electroinduction heater, comprises placing the workpiece in the vicinity of the induction heater, reducing the air present in the vicinity of the workpiece to provide a reduced air atmosphere, and heating the metal by an electroinduction heater in the reduced air atmosphere. The air is advantageously displaced by a protective gas and this is done before the workpiece is heated to a temperature of 350° C. A device for carrying out the heating, comprises a thermally insulated hood which has an interior heating cavity which opens downwardly and which is made gas-proof at its sides and top. A thermally insulated bottom fits into the opening of the hood and substantially fills the cavity and it is provided with a support area for the workpiece which, when the bottom is inserted, is positioned alongside the electroinduction heater. A lifting device is associated with the bottom for raising it into the cavity and for lowering it downwardly out of the cavity when the workpiece is to be removed.

14 Claims, 1 Drawing Figure

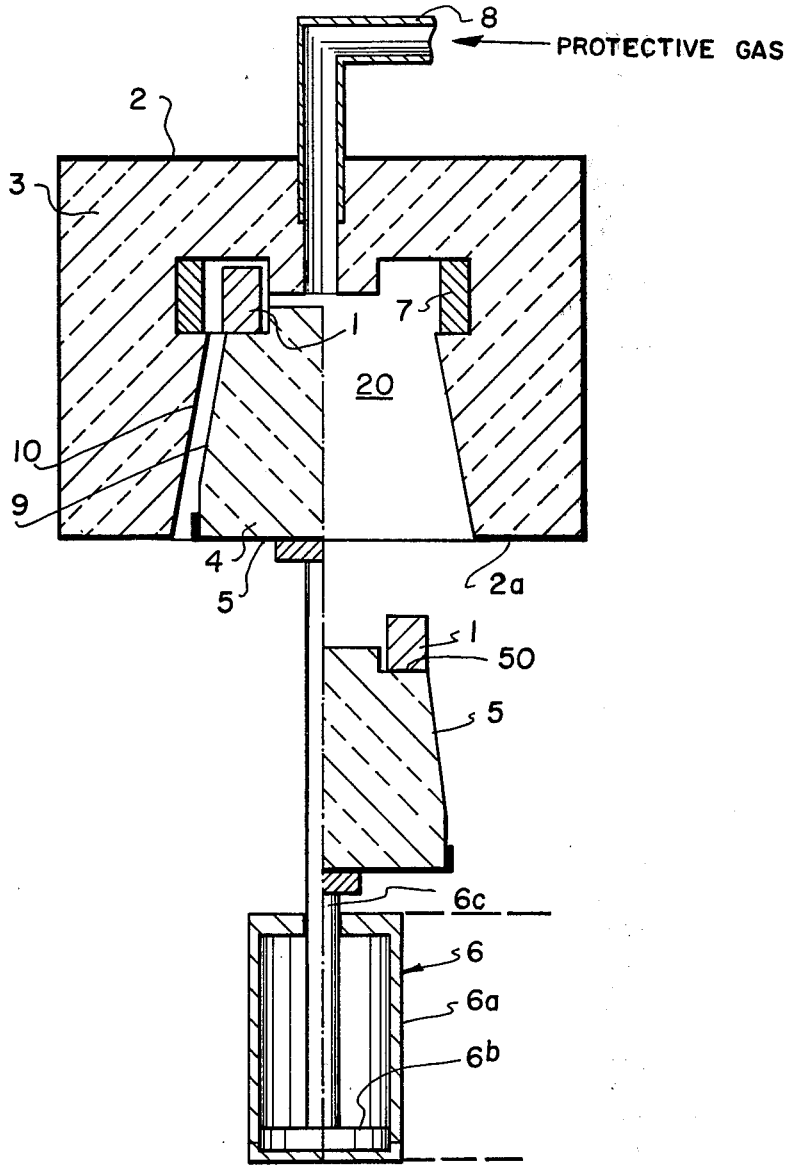
8
PROTECTIVE GAS
2
3
7
1
20
10
9
4
5
2a
1
50
5
6c
6
6a
6b

METHOD AND APPARATUS FOR THE ELECTROINDUCTION HEATING OF METAL WORKPIECES

This is a continuation of application Ser. No. 701,129 filed June 30, 1976, abandoned.

FIELD AND BACKGROUND OF THE INVENTION

This invention relates in general to a method and device for heating metal workpieces and, in particular, to a new and useful method and device for the electroinduction heating of metal workpieces in a manner to minimize any tendency to scale formation and decarburization.

DESCRIPTION OF THE PRIOR ART

The present invention relates to a method and device for an electroinduction heating of metal workpieces, in which the scale formation and decarburization are materially reduced. In the well-known process of induction heating, the phenomena of scale formation and decarburization which depends on heating time can be held within limits only as long as the rate of heating is fast. As the size of the workpieces increase, however, the period of time necessary for the heating increases rapidly, particularly due to the skin effect, i.e., the development of heat primarily in the superficial zones of the workpiece. Thereby, even in the course of the heating operation, the surface of the workpiece becomes so hot that it is capable of chemically reacting with the surrounding atmosphere. In this way, for example, oxygen, water vapor or carbon dioxide contained in the atmosphere may cause a decarburization and/or scale formation.

With workpieces which may be given an entire heat treatment cycle within the furnace, the scale formation and decarburization may be avoided simply by excluding air and using a protective gas, e.g., from the start of heating up to the end of the cooling period. If, however, for purposes of further treatment, the workpieces have to be removed rapidly from the furnace during high temperature heating, difficulties arise. Such heating operations are provided primarily for hardening steel parts and for forging workpieces made of metals and alloys or bodies prepared by compression of powders of such metals or alloys. The difficulty is that, because of the necessity of removing the workpieces after heating, the furnace space must be opened in consecutive, short periods of time, wherefore, a penetration of air from the outside into the protective-gas atmosphere of the furnace is inevitable. In steel hardening processes where the workpieces have usual hardening temperatures of 800° C. to 900° C., numerous measures are provided during the removal of the workpieces for hindering the mutual diffusion of the protective gas and the ambient air, which diffusion progresses very rapidly because of the difference in density of the involved gases. Several methods are used to avoid this, for example, a plurality of workpieces is removed simultaneously in order to reduce the number of the door opening operations; the furnace is designed with a long, narrow neck; air locks are used; large volumes of protective gas are directed through the furnace so that, at the openings of furnace space, the gas escapes at high velocities; or a combination of such measures are used.

With workpieces to be heated to forging temperatures, which are considerably higher than the hardening temperatures and which amount, for example, to 1000° C.–1250° C. for steel, the difficulties are even greater. Since the difference in density between the protective gas in the furnace space and the ambient air is greater, due to the higher temperature, the natural tendency of the gases to diffusion is increased. The measures for preventing such a diffusion, known from the hardening processes, are impractical. For example, the workpieces must be removed from the furnace individually, that is, the operation of heating workpieces to the forging temperature must be synchronized so as to deliver the workpieces individually, in accordance with the required forging cycle, and the temperature from piece to piece must be uniform. This temperature must not be substantially lower than the maximum temperature to which the workpiece has been heated in the furnace space. Because of the necessity of removing the workpieces individually, the discharge opening of the furnace must remain open for a substantial part of the total time of treatment and, consequently, a controlled furnace atmosphere can be maintained.

For a usual cycle of, for example, 2 to 10 seconds for forging workpieces of steel having individual weights of 0.5 to 2 kg, and assuming a door opening time of 2 seconds, the resulting proportion of the door opening time for the removal of a single workpieces from the furnace space, related to the duration of the cycle, is 100%, to 20%. If, in order to avoid the mutual diffusion between the atmospheres of the furnace space and the ambience, the furnace is designed with a long neck, the relative door opening time would be extended. In view of the short operating cycles, air locks are prohibitive because it is difficult to scavenge the locks sufficiently during the intervals between the opening times of the inner and outer doors. The use of greater volumes of protective gas is impractical because of the costs and the necessity of heating such volumes up to the operational temperature of the furnace.

Heating of workpieces rapidly within 10 to 40 seconds is known. This rapid heating is to prevent a chemical alteration of the surfaces, which alteration, as a process resulting from a diffusion, largely depends on time. It is true that with shorter heating times, the surface reactions, for example, a decarburization of and scale formation on steel, can be reduced. However, such heating times are inhibited by the difficulty of determining the end point of heating with a satisfactory accuracy. With longer heating times in air, an oxidation is clearly recognizable even on workpieces of forging steel.

An elongated applicator coil is known in which a plurality of workpieces are placed and heated simultaneously. Experience has shown applicant, in tests which have not been published, that the exposure of such a coil to a protective gas, having to prevent surface reactions, leads to unfavorable results. Aside from the aforementioned difficulty, it was found that for removing the workpieces, the space accommodating the coil must be opened at both ends at least in the rhythm of the forging cycle, which makes the control of the protective gas difficult, the flow conditions of the protective gas in the furnace vary in addition, with the varying temperature distribution in the workpieces. For example, if hollow cylinders are heated, which for reasons of the electromagnetic coupling, have to pass through the applicator coil in coaxial alignment therewith, a quasi tubular body is formed in the interior of which a thermal current is produced in the direction from the cold to the hot end. This current is stronger than the current produced in the annular gap between the induction coil and the workpieces. The intended control of the protective gas in the interior of the coil is thereby strongly affected. Particularly upon starting such plants after a standstill or disturbance, the adjustment of the desired stationary conditions of operation requires much time. Workpieces which are heated during such an adjusting time either cannot be used in the manner provided or can be used only partly or after an appropriate additional treatment. In view of these difficulties and the high costs connected to the control of an elongated applicator coil for obtaining an accurate adjustment to the desired final temperature of the workpiece, this method is disadvantageous.

With larger workpieces of steel, in particular, the negative influence of a harmful ambient atmosphere becomes more important, since with the increasing size of the workpiece, the time necessary for heating the workpieces clear through increases very rapidly, primarily due to the skin effect of the induction heating.

This applies to a larger extent to workpieces of pressed powders, since such workpieces have not the theoretical, maximum, density of the steel, but are porous. It makes no difference whether the workpieces are bodies formed by compression of metal powders with suitable additives or bodies which, after their formation by compression, have been subjected to additional sintering and only thereupon heated for the forging operation. In both cases, the workpieces have a density which is smaller than the maximum, theoretical, density, and the gases from the atmosphere surrounding the workpiece can penetrate into the pores of the workpiece in a relatively easy manner. Therefrom, they diffuse into the interior of the porous body where they are capable of causing chemical alterations. Tests have shown that under comparable conditions of time, temperature and chemical composition of the workpieces, the depth of decarburization occuring in workpieces of porous materials during a heating to the forging temperature, is up to 10 times greater than in workpieces of massive material, even in cases where the density of the porous material is 90% of the maximum, theoretical, density.

SUMMARY OF THE INVENTION

The present invention is directed to a method making it possible to heat metal workpieces, even workpieces which are pressed of powder, or pressed and sintered, up to a forging temperature, while maintaining an optimum control of the heating operation and reducing both the formation of scale and the decarburization to a minimum, even in cases where the following forming machine works with a varying operational cycle.

For this purpose, in accordance with the invention, it is provided that the workpieces are heated individually and that the quantity of the air present in the ambience of the workpiece during the heating operation is reduced. Thereby, due to the individual treatment, a flexibility is obtained both in the control of the heating operation and in the adjustment to a possibly varying forging cycle. The individual heating makes it possible also to reduce the amount of the air present around the workpiece during the heating operation. In this respect, the invention begins with the following consideration: The strongest and weightiest disturbances resulting from the reaction of the surface of the workpieces to be heated for forging, with the ambient atmosphere, are caused by the oxygen present in the air. One of the most sensitive surface reactions is the decarburization of the surface layer of the steel. It precedes the formation of scale. Small amounts of air are sufficient for a skin decarburization. As to the reduction of the air quantity in the ambience of the workpieces, the invention utilizes the fact that during the heating, the mass of the air contacting the surface of the workpiece becomes strongly rarefied, due to its thermal expansion. Because of the individual heating, it is possible to enclose the workpiece hermetically, while leaving an outlet slot, so that the air displaced by the thermal expansion can no longer react with, and thereby, harm, the surface of the workpiece.

More particularly, the method may include the following features: While heating workpieces having a favorable shape, the workpiece may be enclosed so closely that the simultaneously enclosed air volume is very small and the air quantity present around the workpiece becomes so greatly reduced that a sensible, detrimental, influence on the workpiece is avoided. With workpieces having less favorable shapes and correspondingly larger air volumes simultaneously enclosed with the workpiece, it is recommended, in accordance with the invention, to provide the use of a protective gas by which the air surrounding the workpiece during the heating operation is displaced.

To this end, the protective gas is advantageously supplied in an amount such as to displace the air surrounding the workpiece before the workpiece attains a temperature of 350° C. In this respect, the heating utilizes the circumstance that, contrary to the known heating of a plurality of workpieces in a single applicator, the individually heated workpiece, since it is separated in space from other workpieces which are heated to a high temperature, has, for a certain period of time, such a low superficial temperature that, for that time, no mutual reactions with the ambient atmosphere take place. During this time, the air present in the heating space as from the charging operation is displaced by the protective gas. While transferring the workpieces into the zone of action of the applicator coil by which the induction heating is effected, strong forces are exerted on the workpiece at the end of the coil, which forces are caused by the inhomogeneity of the field and may sometimes lift the workpiece from its support in an uncontrolled manner. To prevent such a lifting, the induction heating is switched off during the introduction of the workpieces.

Another embodiment of the invention provides that, prior to introducing the workpiece into the applicator field, the workpiece is secured to its support. In this case, there is no need for switching the induction heating off during the introduction of the workpiece.

Because of the skin effect of high-frequency AC currents, appearing during the induction heating, the heating of thickwalled workpieces is effected by heat conduction from the outside inwardly. For thick-walled workpieces in particular, and also for workpieces having a relatively low thermal conductivity, it is recommended, in accordance with the invention, that the workpieces be heated intermittently. By interrupting the heating operation, the development of a very high surface temperature before the workpiece is sufficiently heated through is avoided due to the continuing equalization taking place during the heating pause, and a uniform temperature in the entire workpiece is thereby ensured. The intermittent heating may be effected in a particularly simple manner by providing that a plurality of series connected applicator coils is loaded and unloaded in a uniform cycle, one after the other in an overlapping manner, and during each loading and unloading operation, all coils are de-energized.

Quite satisfactory and faultless products result from the inventive process, particularly with pressed or pressed and sintered metal powder bodies, which was not possible by methods known up to date, because the sensitive pressed bodies with the inventive method are protected against the ambient atmosphere.

The invention is further directed to a device for carrying out the inventive method, making it possible to handle the workpieces in a simple and secure manner. The device substantially comprises a thermally insulated hood which is open downwardly and gas-proof at its sides and top. A thermally insulated bottom fits into the underside opening of the hood. A transfer device or drive is adapted to move the hood and the bottom relative to each other. An induction coil is accommodated in the hood. Since the hood is open only in the downward direction, the air volume surrounding the workpiece is efficiently limited. As the workpiece is heated, a part of the simultaneously heated air is displaced and escapes in a laminar flow between the lower edge of the hood and the bottom to the outside. A penetration of fresh air by convection is avoided. The insulation of the hood and bottom reduces the thermal losses.

As for particulars, the device may be designed as follows: Protective gas may be supplied through a gas pipe opening into the hood. Since the hood is open downwardly, a reliable control of the atmosphere is ensured with small quantities of supplied protective gas.

With a transfer device acting on the bottom and a fixed hood, a rigid wiring for the induction coil may be provided in the hood, which facilitates a low-inductance design. If the transfer device for the bottom is designed as a hydraulic cylinder, the bottom may be moved in the vertical direction. The lifting device may also be operated pneumatically or desinged as a crank drive. For simplifying the insertion and removal of the workpiece in lowered position, the bottom is freely accessible from all sides, which facilitates the handling.

In another embodiment of the invention, the transfer device acts on the hood and the bottom is fixed. This design is advisable primarily in cases where a small elevation of the working plane above the floor of the plant is to be observed and constructions below the floor of the plant are to be avoided. The motion of the hood or bottom, however, may also follow other than a straight path, provided the shape of the workpiece is suitable or such a travel is needed, for example, because of the conditions of the working space.

By designing the hood as a hollow cylinder and the bottom with a circular horizontal cross-section, the manufacture of the device is simplified and a narrow gap between the bottom and the hood in closed position is easily obtained.

In order to avoid damaging of the refractory lining during the closing motion of the bottom, the refractory lining of the bottom is tapered upwardly and the refractory lining of the hood is correspondingly flared downwardly. If the hood is designed as a hollow cylinder, the tapering of the refractory lining of the bottom is frustoconical and the refractory lining of the hood is conformable.

Particularly small enclosed air volumes or protectivegas quantities necessary for the displacement thereof may be obtained by an appropriate dimensioning of the refractory lining of the hood and bottom, so as to have the workpiece, in the uppermost position of the bottom, closely surrounded on all sides. For workpieces having very unequal dimensions in the three spatial directions, it may be useful to abandon the cylindrical shape of the hood and to provide a prismatic shape instead, which is adapted to the leading dimensions of the workpiece.

Accordingly, it is an object of the invention to provide a method of heating metal workpieces so as to minimize scale formation and decarburization using an electroinduction heater which comprises placing the workpiece in the vicinity of the heater, and before the heating is carried out, to bring the temperature of the workpiece up to over 350° C. so that the air present in the vicinity of the workpiece is reduced.

A further object of the invention is to provide a device for heating metal workpieces which includes a hood having a cavity therein with an electroinduction heater and which is opened on a side to the cavity and which includes a closure member having means for carrying a workpiece which is adapted to be inserted into the cavity to substantially reduce the size of the cavity and position the workpiece in association with the heater.

A further object of the invention is to provide an apparatus for the heating of metal workpieces which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

BRIEF DESCRIPTION OF THE DRAWING

The only FIGURE of the drawing is a transverse sectional view of a device for heating metal workpieces in accordance with the invention and showing a workpiece support member in an operative and inoperative position.

DESCRIPTION OF THE PREFERRED EMBODIMENT

Referring to the drawing in particular, the invention embodied therein, comprises an apparatus for heating metal workpieces in a manner such that they do not have a tendency to scale or decarburize and which includes a hood or top portion 2 of a housing which has a cavity 20 which defines a heating chamber. The heating chamber contains an induction heater 7 and the chamber opens downwardly from a bottom **2*a* of the hood. Hood 2 is constructed so as to be closed gastightly at its sides and its top and the interior of the hood is provided with a thermal insulation 3**.

In accordance with a feature of the invention, a bottom member or workpiece support member 5 fits into the opening of the bottom and into the cavity 20 and occupies at least a major portion of the cavity 20 so as to reduce the air atmosphere surrounding a workpiece 1 which is supported on a support means or ledge 50 of the support member 5. The support member 5 is also provided with a thermal insulation 4 and it is supported for movement into and out of the cavity 20. It is moved by a transfer or lifting device 6 which comprises a fluid pressure cylinder 6a and a piston 6b slidable in the cylinder which has a connecting rod 6c which is connected to support member 5.

The hood is advantageously provided with a gas conduit 8 which opens downwardly into the top of the cavity 20 and supplies a protective gas into the cavity which will surround the workpiece during the heating.

Advantageously, the support member is frusto conically tapered along its sides 9 and the hood cavity tapers in an opposite complementary direction outwardly toward the bottom 2a along tapered walls 10.

In accordance with the method of the invention using the apparatus, the workpiece is either positioned in the cavity 20 alongside the induction heater 7 and initially heated, or it is supported on the support means 50 of support member 5 and raised into position within cavity 20 by the movement of support member 5 through transfer device 6. In any event, the air atmosphere is reduced by reducing the size of the cavity by the insertion of the support member 5 therein.

With the inventive device, the method is carried out such that the workpieces are individually heated and the quantity of air surrounding the workpieces during the heating operation is reduced. The coil 7 is first de-energized and the bottom 5 is loaded in its lowermost position as shown to the righthand side of the drawing. The bottom 5, loaded with workpiece 1, is then lifted into the hood to the uppermost position, whereupon, the coil is energized and, if provided, a protective gas is supplied through the conduit 8 into the working space. If a combustible protective gas is employed, its ignition and combustion at the outlet gap formed between the walls 9 and support member 5 and the wall 10 of the hood is provided by an igniting device (not shown).

The supply rate of the protective gas which is fed through the conduit 8 into the cavity 20 is predetermined so as to obtain a sufficient scavenging of the hood before the workpiece attains a surface temperature of 350° C. In addition, the supply rate is so high as to efficiently prevent a diffusion of the air oxygen from the outside through any spacing between the walls 9 and 10. As soon as the workpiece 1 attains the desired temperature, the coil 7 is de-energized and shortly thereafter the supply of the protective gas is stopped and the bottom 5 is lowered in order to permit removal of workpiece 1 for the forging operation. The entire cycle is then repeated. Should the heating speed be unsatisfactory for the required forging cycle of treatment of the metal, any number of such heating devices may be cyclically connected to each other. In this manner, workpiece 1 may be heated with a minimum of scale formation and decarburization and it will always be available in the desired periods of time. The method is particularly advantageous for workpieces which are made of pressed powders or powders which are pressed and then sintered and which are very susceptible to reactions with the ambient atmosphere.

While a specific embodiment of the invention has been shown and described in detail to illustrate the application of the principles of the invention, it will be understood that the invention may be embodied otherwise without departing from such principles.

What is claimed is:

1. A method of heating metal workpieces by induction so as to minimize scale formation and decarburization, said method comprising the steps of:

providing relative vertical movement between a workpiece surrounded by air and a heat-resistant hood defining a cavity open at the bottom of the air, said relative vertical movement causing said workpiece to be within the upper part of said cavity and closely surrounded above and on the sides by said hood, filling substantially all of the remainder of said cavity below said workpiece with non-conductive, solid, heat-resistant material to displace substantially all of the air originally within said hood but leaving an air passage from said upper part of said cavity down through the lowermost part of said cavity to the surrounding air; and inductively heating said workpiece.

2. The method of claim 1 in which said hood is maintained substantially stationary and said workpiece is moved upwardly into said cavity.

3. The method of claim 1 in which the air is the only gas in said hood from the time of entry of said workpiece into said cavity until the end of said inductive heating.

4. The method of claim 1 comprising the additional step of displacing substantially all of the remainder of air in said hood by directing protective gas therein only after said workpiece and said non-conductive, solid, heat-resistant material have already displaced substantially all of the air originally in said hood.

5. The method of claim 4 in which said protective gas is directed into said hood before said workpiece is heated to a temperature of about 350° C.

6. The method of claim 1 in which inductive heating energy is not supplied inside said hood until after said workpiece is positioned in said cavity.

7. The method of claim 1 comprising inductively heating said workpiece intermittently to allow temperature equalization to proceed within said workpiece without heating the surface of said workpiece beyond a predetermined temperature.

8. The method of claim 1 in which said workpiece comprises compressed metal powder prior to said step of inductively heating said workpiece.

9. Apparatus for inductively heating metal workpieces so as to minimize scale formation and decarburization, said apparatus comprising:

a heat-resistant hood comprising a gas-tight top and gas-tight sides defining a cavity open at the bottom;

means to effect relative vertical movement between said hood and a workpiece to cause said workpiece to be within the upper part of said cavity, the configuration of said upper part of said cavity relatively closely fitting the top and sides of said workpiece;

inductive heating coil means within said hood and adjacent said workpiece within said cavity; and non-conductive, solid, heat-resistant means substantially filling the remainder of said cavity below said workpiece but defining a limited air passage through the bottom of said hood to the surrounding air.

10. The apparatus of claim 9 in which said hood comprises a refractory lining defining said cavity.

11. The apparatus of claim 9 in which said cavity is tapered and is larger at the bottom than at the top.

12. The apparatus of claim 11 in which said non-conductive, solid, heat-resistant means is tapered substantially to conform to the tapered cavity.

13. The apparatus of claim 9 in which said solid, heat-resistant means is sufficiently rigid to support said workpiece.

14. The apparatus of claim 13 in which said hood is substantially stationary and said means to effect relative vertical movement comprises fluid-operated cylinder-and-piston means to support said non-conductive solid means and said workpiece thereon.

* * * * *